United States Patent [19]

Nichols

[11] Patent Number: 4,874,211

[45] Date of Patent: Oct. 17, 1989

[54] FOLDABLE UTILITY CABINET

[76] Inventor: Walter G. Nichols, 2112-F Sunnydale Blvd., Clearwater, Fla. 34675

[21] Appl. No.: 295,842

[22] Filed: Jan. 11, 1989

[51] Int. Cl.[4] ..... A47B 49/00

[52] U.S. Cl. ..... 312/269; 312/248

[58] Field of Search ..... 312/248, 267, 269, 276; 211/1, 3, 99

[56] References Cited

U.S. PATENT DOCUMENTS

| | | | |
|---|---|---|---|
| 119,962 | 10/1871 | Breed | 312/269 |
| 2,061,010 | 11/1936 | Sticht | 312/269 |
| 2,537,669 | 1/1951 | Honig | 312/269 |
| 2,679,446 | 5/1954 | Weil | 312/269 |
| 2,880,918 | 4/1959 | Schweikhard | 312/269 X |
| 3,205,032 | 9/1965 | Leigh | 312/248 X |
| 3,995,926 | 12/1976 | Kessler | 312/269 X |
| 4,085,987 | 4/1978 | Vartdal | 312/269 |

*Primary Examiner*—Joseph Falk

*Attorney, Agent, or Firm*—Herbert W. Larson

[57] ABSTRACT

A fold-out door is hinged at its bottom to the bottom of a cabinet frame. Parallel first spaced apart side support members are integral with the inner surface of the door and are connected by multiple parallel dowels mounted at right angles to the side supports. Parallel second spaced apart side supports are hinged to the first side supports and are connected by multiple additional dowels. Removable compartments rest on a dowel connecting the first side support members and another adjacent dowel connecting the second side support members. The compartments remain in a level upright position whether the door is latched to the cabinet or in a folded out position.

4 Claims, 2 Drawing Sheets

FOLDABLE UTILITY CABINET

BACKGROUND OF THE INVENTION

1. Field of the Invention

This invention relates to foldable wall cabinets. More particularly, it refers to a wall mounted cabinet having a bottom hinged door exposing when open on its inside surface, a series of compartments for storage of utility items such as screws, bolts, nuts and washers.

2. Description of the Prior Art

Foldable wall mounted utility cabinets are well known as shown by U.S. Pat. No. 2,537,669. In this cabinet, shelves swivel in and out with the corresponding closed or open position of the lower hinged door. In another reference, U.S. Pat. No. 2,880,918, utility box compartments swivel on a side cabinet mounting bracket. These prior art cabinets do not present multiple removable storage compartments in a readily accessible fashion. For purposes of storing various sizes of screws, nuts and bolts and washers, such removable and accessible compartments are highly desirable.

SUMMARY OF THE INVENTION

I have invented an easily assembled cabinet in which removable compartments are spaced closely together to prevent tipping and each enclosed compartment is in a readily accessible position.

The cabinet has a frame with a lowerable front door hinged to a bottom of the cabinet frame. A first pair of parallel spaced apart side supports are integral with an inside flat surface of the front door. A second pair of parallel spaced apart side supports are hinged to the first pair of side supports and multiple dowels connect each pair of side supports. Compartments having front and rear protrusions rest on the dowels with one end of the compartment resting on a dowel connecting the first pair of side supports and the other end of the compartment resting on a dowel connecting the second pair of side supports. This permits the compartments to be represented in the same upright configuration whether the foldable door is open or closed.

BRIEF DESCRIPTION OF THE DRAWINGS

The invention may be best understood by those having ordinary skill in the art by reference to the following detailed description when considered in conjunction with the accompanying drawing in which.

DETAILED DESCRIPTION OF THE INVENTION

Figure 1:
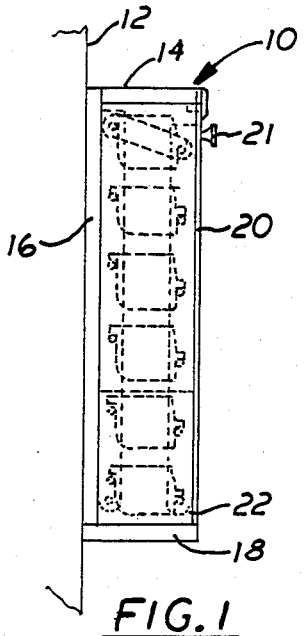
FIG. 1 is a side view in elevation of a wall mounted cabinet of the invention with interior compartments in phantom.
Figure 2:
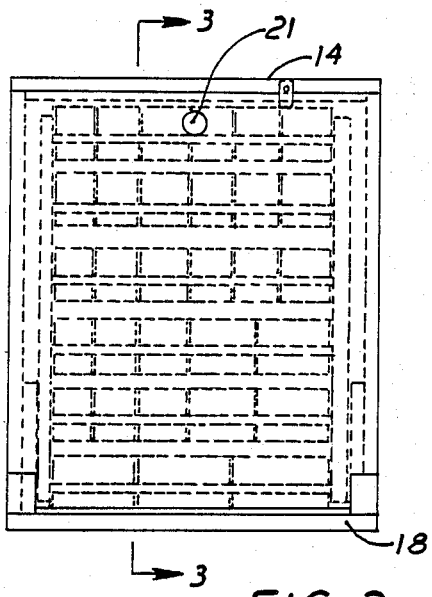
FIG. 2 is a front view in elevation of the cabinet with interior compartments in phantom.

Throughout the following detailed description, the same reference numerals refer to the same elements in all figures.

Referring to FIG. 1, the cabinet 10 is mounted on a wall 12. The frame of the cabinet has a top 14, backwall 16, bottom 18 and a pair of sides 46. A pivoting fold-out door 20 has a gripping knob 21 for convenience. Door 20 pivots at its bottom 22 with respect to block 50 attached to the bottom of each side wall 46 of the cabinet 10.

Figure 4:
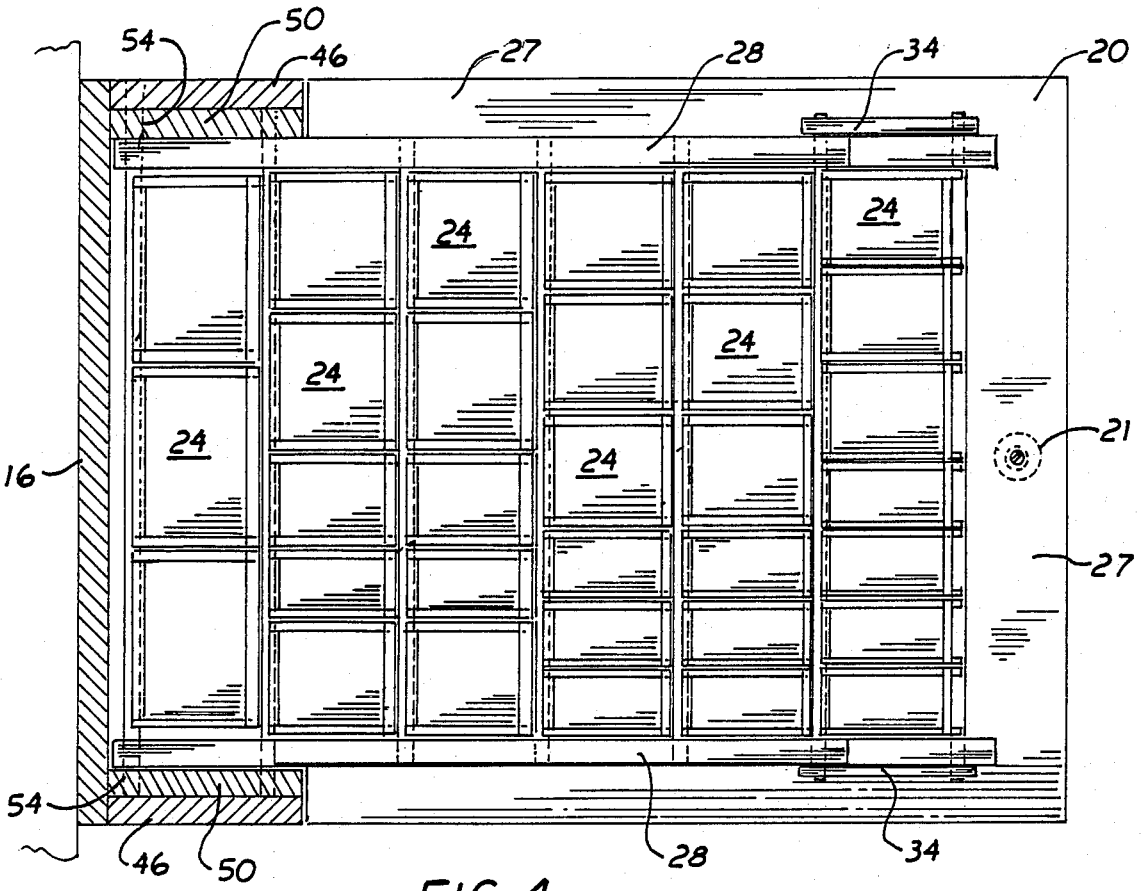
FIG. 4 is a top plan view of an open cabinet door with the cabinet frame partially in section.
Figure 5:
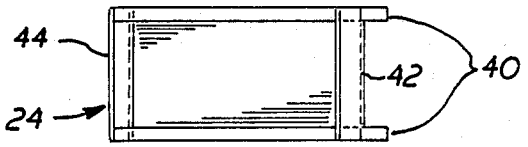
FIG. 5 is a top plan view of a removable compartment.
Figure 6:
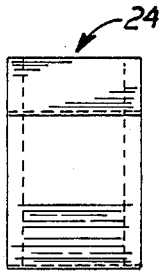
FIG. 6 is a bottom plan view of a removable compartment.
Figure 7:
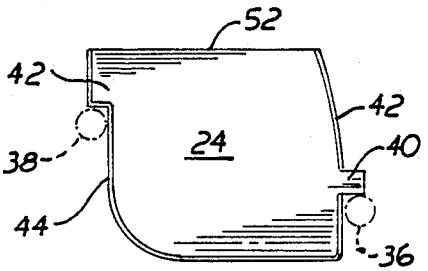
FIG. 7 is a side elevation of a compartment supported by cabinet dowels.
Figure 8:
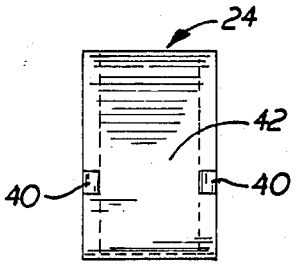
FIG. 8 is a front view in elevation of a removable compartment.

Referring to FIG. 4 the door 20 folded out from the cabinet frame exposes multiple removable compartments 24.

Figure 3:
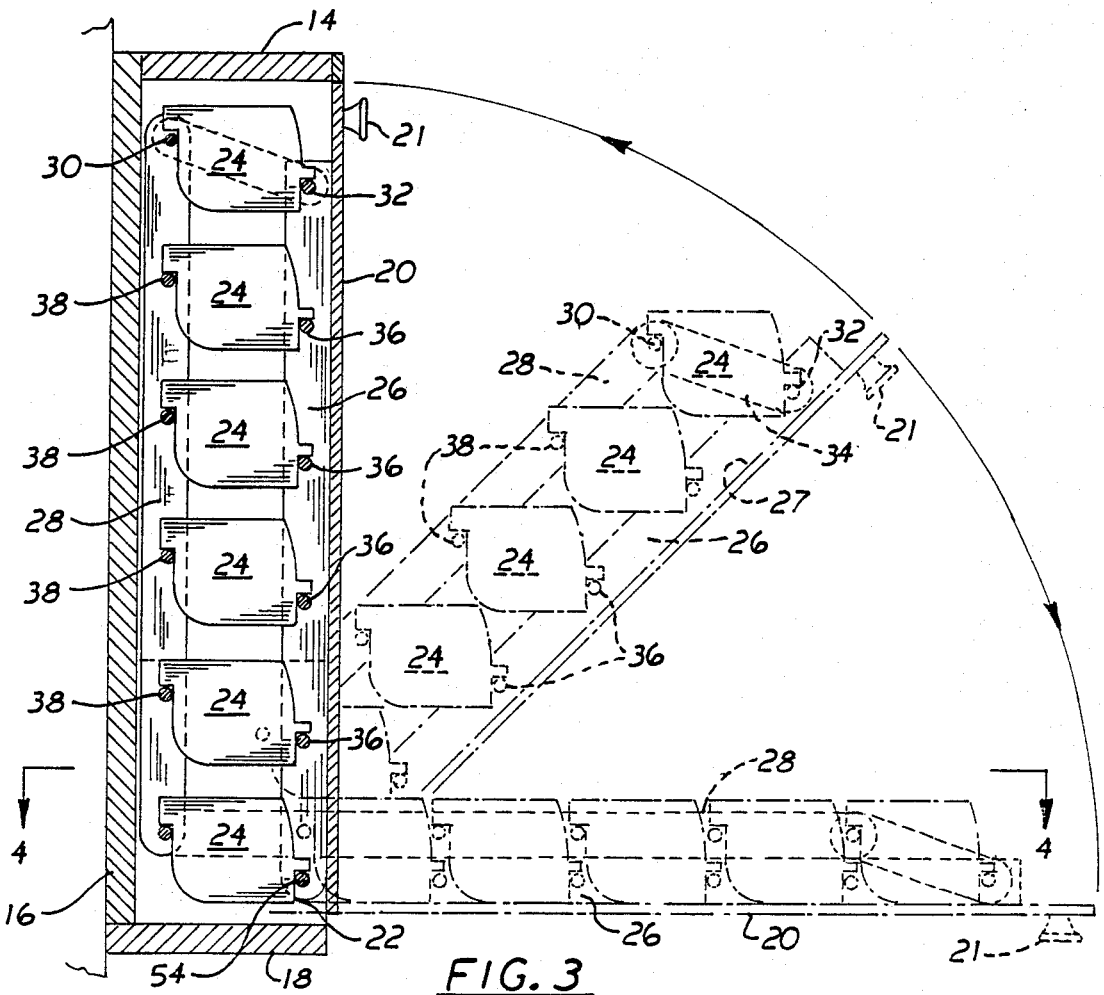
FIG. 3 is a section view along lines 3—3 of FIG. 2.

FIG. 3 shows the right side of a pair of first support members 26 integral with the inner surface 27 of door 20. A second pair of support members 28 are hinged at 30 and 32 to corresponding first support members 26. Bracket 34 keeps the right side first support member 26 and the right side second support member 28 spaced apart in the vertical or intermediate position. As seen in FIGS. 3 and 4, the first and second side support members 26 and 28 meet in the fully folded down position.

A first set of parallel rods 36 connect the right and left first side support members 26. A second set of parallel rods 38 connect the second right and left side support members 28.

A pair of front protruding fingers 40 are located on a front surface 42 of the compartment 24 and a single protrusion 42 is located on a back surface 44 of compartment 24.

The cabinet 10 can be made of wood or a plastic substance such as polyethylene or polypropylene. The dowels are normally made of wood but could be rods of polyethlyne or polypropylene. The rods 36 and 38 are glued into holes drilled into the side support members 26 or 28. The containers 24 also can be made of wood or a plastic substance such as polyethylene or polypropylene. The front portion 42 of the compartments 24 can be faced with an aluminum or stainless steel surface for added durability.

The front edge of side walls 46 of the cabinet 10 will fit flush along the interior surface 27 of the door 20 when in the closed position. A spacing block 50 is located between the side support members 26 and the side walls 46 of the cabinet 10.

As the door 20 is moved upwards from its position shown in FIG. 4 to the position shown in FIG. 1 the compartments 24 pivot on the dowels 36 and 38 so that the top surface 52 of the compartments 24 remains parallel to the bottom 18 of the cabinet 10.

The compartments 24 do not need top closures since the adjacent compartments 24 on the next row act as a lid and prevent spilling of the screws or other utility items contained within the compartments. Each compartment 24 is closely spaced together as shown in FIG. 4 so that there cannot be jarring of the various compartments. However, each compartment 24 is removable for easy access to the utility items contained within.

The cabinet 10 can be screwed or nailed to a wall 12 through a back wall 16. The bottom of the door 20 pivots on a dowel 54 connecting to the side blocks 50.

Equivalent materials can be substituted for the wood and plastic used in the invention and various size compartments 24 can be used in the cabinet as shown in FIG. 4.

Having thus described the invention, what is claimed and desired to be secured by Letters Patent is:

1. In a utility cabinet for wall mounting having a frame with a bottom member and hollow interior and a lowerable front door having longitudinal sides and a bottom hinged at its bottom to the bottom of the cabinet frame, the improvement comprising:

a first pair of parallel side support members spaced apart from each other, each side support members integral with an inside surface of the front door, the side support members each located interior to and spaced apart from a longitudinal edge of the front door; a second pair of parallel support members spaced apart from each other hinged to the first pair of side support members and spaced apart from the first pair of side support members in an open configuration, with the hinges maintaining the first and second pairs in parallel spaced apart relation;

a first set of multiple parallel rods mounted at right angles to and connecting the first side support members; a second set of multiple parallel rods mounted at right angles to and connecting the second pair of side support members;

multiple removable compartments each resting on a rod connecting the first side suppor members and an adjacent rod connecting the second side support members, so that each compartment remains upright whether the front door is in a locked configuration to the cabinet frame or is hinged away from the cabinet frame.

2. The improved utility cabinet according to claim 1 wherein the first and second set of multiple parallel rods are dowels of substantially the same length and diameter.

3. The improved utility cabinet according to claim 1 wherein a protrusion on each compartment rests on a rod connecting the first side supports and a rear surface protrusion rests on an adjacent rod connecting the second side support member.

4. The improved utility cabinet according to claim 1 wherein each compartment closely abuts a laterally adjacent container and contains a cavity for storing utility items.

* * * * *